United States Patent [19]

Barker et al.

[11] 4,078,663

[45] Mar. 14, 1978

[54] METHOD AND APPARATUS FOR SEPARATING SEEDS

[76] Inventors: Jeffrey George Barker, 92 Totteridge Dr., High Wycombe, Buckinghamshire; Keith Lewis Pratt, 31 Campion Rd., Widmer End, High Wycombe, Buckinghamshire, both of England

[21] Appl. No.: 651,206

[22] Filed: Jan. 21, 1976

[30] Foreign Application Priority Data

Jan. 28, 1975 United Kingdom ..... 3747/75

[51] Int. Cl.[2] ..... B07C 9/00

[52] U.S. Cl. ..... 209/76; 209/114

[58] Field of Search ..... 209/90, 91, 76, 77, 209/78, 114

[56] References Cited

U.S. PATENT DOCUMENTS

| | | | |
|---|---|---|---|
| 448,394 | 3/1891 | Wheelan | 209/90 |
| 1,220,657 | 3/1917 | Mahrer | 209/114 |
| 3,211,288 | 10/1965 | Peis | 209/78 |

FOREIGN PATENT DOCUMENTS

| | | | |
|---|---|---|---|
| 91,303 | 1/1938 | Sweden | 209/90 |

*Primary Examiner*—Allen N. Knowles
*Attorney, Agent, or Firm*—McCormick, Paulding & Huber

[57] ABSTRACT

A method and apparatus for separating selected seeds from unwanted seeds wherein a mixture thereof is fed to a moving inclined surface having a pile with fences disposed above the surface and at an angle to the direction of movement of the surface, the unwanted seeds being carried upwards by the pile and the selected seeds being discharged at the bottom.

11 Claims, 6 Drawing Figures

METHOD AND APPARATUS FOR SEPARATING SEEDS

This invention relates to a method and apparatus for separating seeds.

In the growing of crops on an extensive scale, it is necessary to ensure that the seeds which are selected and sown are free from unwanted seeds and other bodies. Indeed, in the United Kingdom and in other countries of the European Economic Community there is the legal requirement that for a given weight of seed there should not be more than a given number of unwanted seeds. It is, therefore, most desirable to eliminate from a batch of seed to be sown any unwanted seeds or bodies which may be present.

In this Specification the expression "selected seeds" is intended to mean those types of seeds which are to be used for the growing of crops, the outer surface of which is relatively smooth, as distinct from the expression "unwanted seeds and bodies" which is intended to mean those seeds and bodies which it is undesirable to plant when growing a particular type of crop, and which generally have a different size or shape from the selected seeds and/or have a rough, spiked or hairy texture. Examples of selected seeds are cereal seeds, such as wheat, barley, oats, maize and rye, and the unwanted seeds which would normally accompany these cereal seeds would be, for example, wild oats. Another selected seed is clover, and the unwanted bodies which would accompany clover would be Galium aparine L, usually known as cleavers. Also, a selected seed may be wheat and the unwanted seeds may include barley and/or rye.

There are several known techniques for separating selected seeds from unwanted seeds and these techniques are at present employed throughout the world today. Of these may be mentioned sieving which means simply that the seed mixture is passed over a perforated tray. The tray is agitated and large seeds are retained by the tray and small seeds pass through the perforations. This technique gives a reasonable degree of separation but permits some unwanted seeds to pass through the sieve particularly if the shape of the unwanted seeds is elongated, i.e. cigar shaped. Then there is the technique of aspiration in which a jet of air is blown upwardly at an angle while the mixture of seeds is allowed to fall through the jet. The lighter in weight seeds are blown by the jet of air to one side of the stream of mixed seeds, whereas the heavier seeds are less affected by the stream of air and thus separation, to a limited extent, is achieved. Also, rotary cylinders having indentations are provided which pick up some of the seeds and reject others.

In one prior proposal as disclosed in United Kingdom Patent Specification No. 286,926 (Wilder) a machine for separating out the kernels from the meal, shell or the like, after locust beans, nuts and so forth have been disintegrated or crushed comprises an inclined carpet having a backing of fabric with upstanding wires closely arranged together in a uniform array. A single baffle plate is arranged diagonally across the carpet and raised an adjustable amount above the latter. The pips or kernels in the mixture fed to the machine slide smoothly down the carpet and collect at the bottom while the major portion of the meal or shell is arrested between the wires of the carpet and carried upwards and discharged at the top of the machine. In this proposal a hopper feeds the mixture to the carpet, the hopper being reciprocated to distribute the mixture evenly across the carpet. This machine would only effect a limited degree of separation, mainly because the baffle plate acts like a large sieve.

It is the main object of the present invention to provide a method and apparatus for separating seeds which gives a degree of separation for seed mixtures which is more efficient than hitherto.

According to the present invention there is provided a method of separating selected seeds (as herein defined) from unwanted seeds or bodies (as herein defined) which includes feeding a mixture of selected seeds and unwanted seeds or bodies on to a deposit area of a surface of a moving belt, the said surface being inclined to the horizontal and moving upwardly, the angle of inclination of the surface and the speed of movement of the belt being so chosen that the mixture contacts at least one fence disposed at an angle to the direction of movement of the belt, whereby said mixture is deflected laterally across the surface, individual seeds or bodies being repeatedly presented to the surface, thus effecting separation with selected seeds rolling and tumbling down a fence against the direction of movement of the belt and being discharged at the end of a fence and unwanted seeds or bodies being conveyed up the incline in the direction of movement of the belt.

The invention also includes apparatus for separating selected seeds (as herein defined) from unwanted seeds or bodies (as herein defined) which includes a hopper for feeding a mixture of selected seeds and unwanted seeds or bodies to be separated, an endless belt positioned so that its upper surface lies at an angle to the horizontal, means for directing said mixture from the hopper on to a deposit area of said surface, at least one fence disposed immediately above said surface and at an angle to the direction of movement of said surface to deflect said mixture laterally across said surface, individual seeds or bodies being repeatedly presented to the surface, thus effecting separation, means for driving the belt, means for adjusting the speed of movement of the belt and means for adjusting the angle of inclination of said surface.

The invention will now be more particularly described with reference to two embodiments thereof shown in the accompanying drawings, by way of example only, in which.

Figure 1:
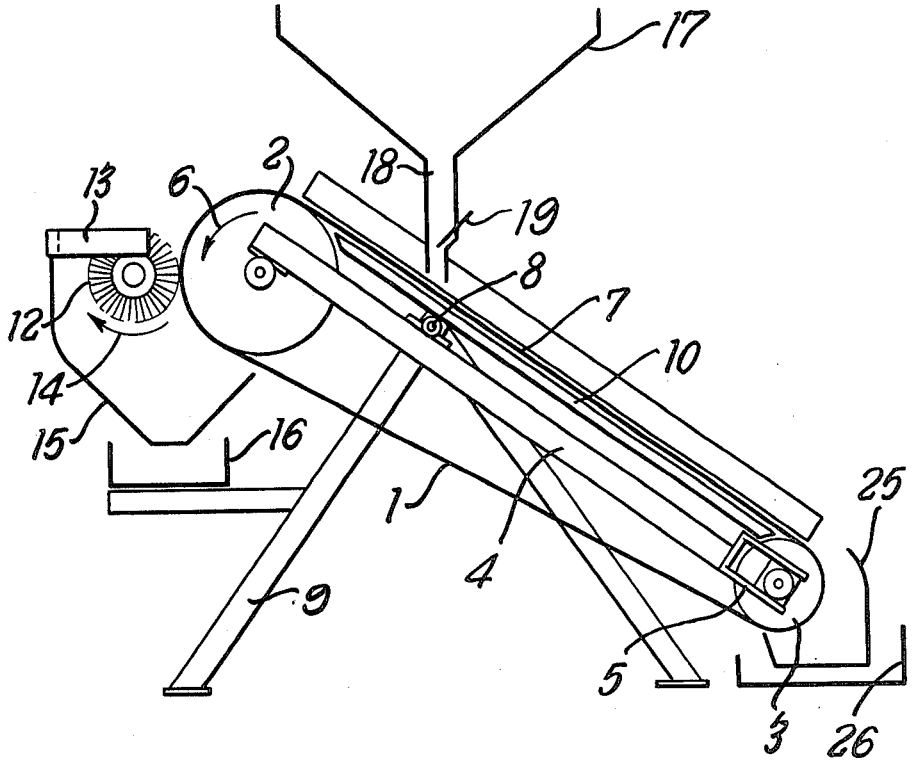
FIG. 1 is a diagrammatic side view of the apparatus constructed according to the invention.
Figure 2:
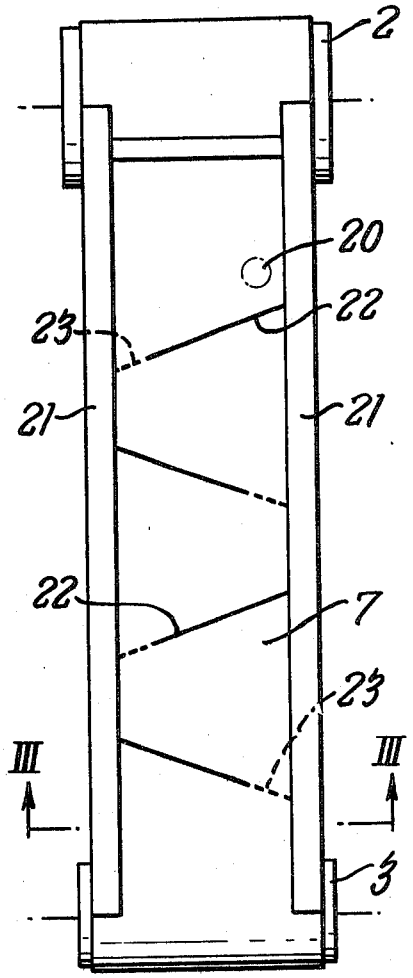
FIG. 2 is a diagrammatic plan view of the apparatus of FIG. 1.
Figure 3:
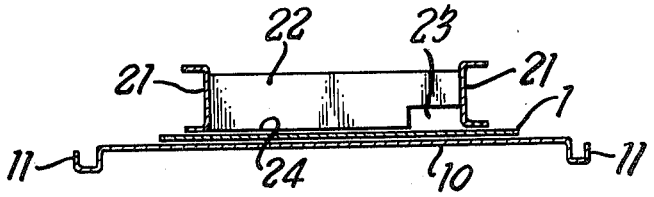
FIG. 3 is a cross-sectional view on the line III—III of FIG. 2.

Referring first to FIGS. 1 to 3, the apparatus includes an endless belt 1 mounted to pass over a large upper driving roller 2 and a small lower idler roller 3 both mounted in a frame 4 with their axes parallel, the smaller roller 3 being provided with means 5 for adjusting the tension in belt 1. An electric motor (not shown) is connected to drive the upper roller 2 in the direction of arrow 6 and thus upper surface 7 of belt 1 moves upwardly from lower roller 3 to upper roller 2.

The assembly of rollers 2 and 3, the belt 1 and frame 4 is pivotally mounted at 8 on a rigid base frame 9 which may be provided with ground engaging wheels so as to make the apparatus readily movable. The pivotal connection at 8 is designed so that the angle of inclination of the surface 7 of belt 1 is adjustable. The motor which drives roller 2 is also adjustable in speed, so that both the speed of movement of the belt 1 and also the angle of inclination of surface 7 are adjustable. It has been found that the angle of inclination of the surface 7 should be between 35° and 45° to the horizontal, dependent upon the type of material being separated and the speed of movement of the belt 1 between 80 ft/min and 110 ft/min.

The upper run of the belt 1 is supported by a flat bed plate 10 stiffened along its length by side channels 11.

A rotary brush 12 is mounted in bearings on extension 13 of the main frame 4, the axis of this brush 12 being parallel with the axis of driving roller 2 and arranged so that the periphery of the brush 12 is just in contact with the belt 1 as it passes round driving roller 2. The brush 12 is driven to rotate in the direction of arrow 14, i.e. the brush 12 and the belt 1 at the line of contact therebetween move in the same direction, but with the brush 12 moving at a greater peripheral speed. Immediately beneath the brush 12 is a discharge chute 15 leading to a container 16 for the collection of unwanted seeds or bodies.

Mounted on the frame 4 is a feed hopper 17 having a feed chute 18 with a throttle device 19 manually controllable so as to vary the rate at which the material to be separated is fed to the belt 1. As marked on FIG. 2, the lower end of the feed chute 18 emerges on to a deposit area 20 on the upper surface 7 of the belt 1. It will be noted that this deposit area 20 is adjacent a longitudinal edge of the belt 1, which is preferable but not essential, and deposits material emanating from hopper 17 on to a selected small area of the surface 7.

Disposed above the belt 1 and parallel with the longitudinal edges thereof are two side members 21 supporting a plurality of fences 22. As will be seen from FIG. 2, these fences 22 are arranged at an angle to the direction of movement of the surface 7 and each fence is arranged at an opposite angle to its neighbour. As will be seen from FIG. 3, each fence 22 is substantially rectangular with an opening 23 at one end thereof. These openings 23 are arranged at opposite ends and at the lower ends of each fence so that the material moves through a tortuous path as it falls down the surface 7.

The lower edge 24 of each fence 22 is either just in contact with or spaced very slightly from the surface 7 of belt 1, apart from the openings 23.

At the lower end of the belt 1 there is provided a chute 25 which leads to a collecting receptacle 26 for the collection of selected seeds.

Figure 4:
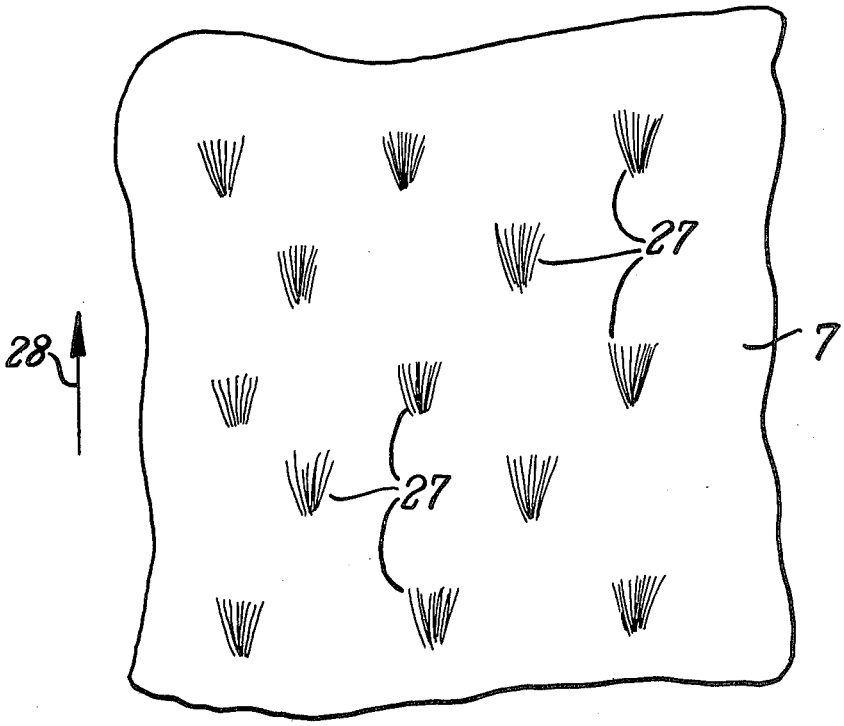
FIG. 4 is a diagrammatic view of the material of which the belt is composed.

In FIG. 4 there is illustrated diagrammatically what the surface 7 of belt 1 looks like and, as will be seen, the surface 7 is provided with a pile composed of bunches of bristles disposed as tufts 27 over the surface of the belt. The direction of movement of the belt 1 is indicated at 28 in FIG. 4 so it will be seen that the tufts are inclined in the direction of movement of the belt. One suitable type of belt 1 is with the bristles composed of nylon on a cotton woven backing and this material then bonded to a two-ply biscuit webbing. The material which carries the bristles may be obtained from Lister & Company Limited, of Bradford, England under Code No. H 1931.

In operation, a mixture of selected seeds and unwanted seeds or bodies is fed from the hopper 17 at a controlled rate by virtue of throttle 19, to deposit area 20 on surface 7. Because of the angle of inclination and speed of movement of the surface 7, the mixture deposited on surface 7 rolls and tumbles downwardly along first one fence, through opening 23 and then downwardly again to the next lowermost fence and successively backwards and forwards laterally across the surface 7 thus proceeding in a tortuous path down the surface 7 repeatedly presenting individual seeds or bodies to the surface for separation. During its passage down the surface 7 the mixture is separated in that unwanted seeds or bodies are caught by the tufts 27 and carried upwardly. The grip of tufts 27 on the unwanted seeds or bodies is sufficiently strong to enable the unwanted seeds or bodies to pass upwards under any fence they may encounter before being discharged from the vicinity of upper roller 2 by the brush 12. The brush 12 in removing unwanted seeds or bodies from the belt 1 also cleans the belt of dirt and dust particles preparatory to its return to the lower roller 3 and further use in separating the mixture.

As the unwanted seeds or bodies are being removed from the mixture the selected seeds will proceed downwardly and will finally be discharged through duct 25 and into receptacle 26.

Figure 5:
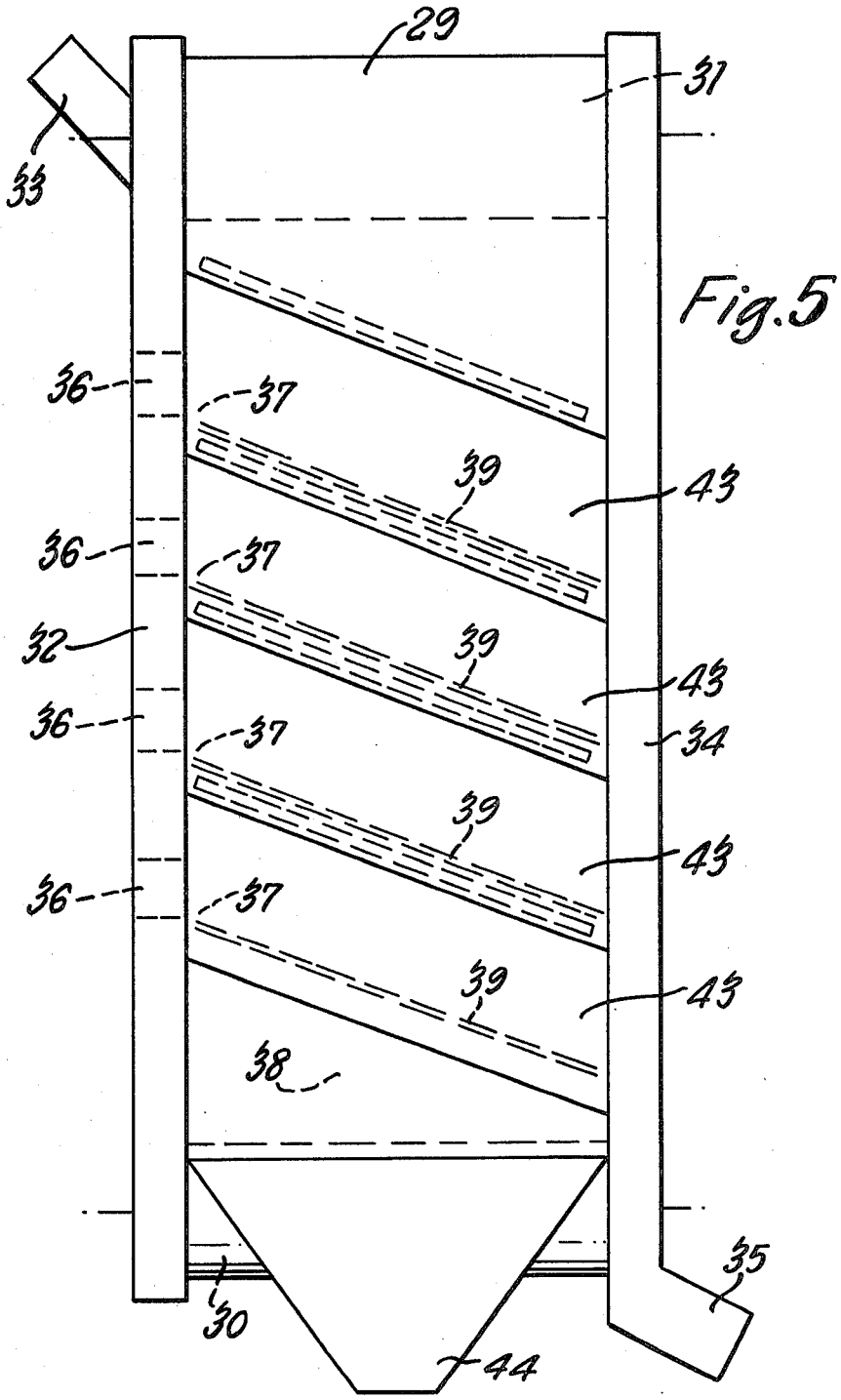
FIG. 5 is a diagrammatic plan view of further apparatus constructed in accordance with the invention.
Figure 6:
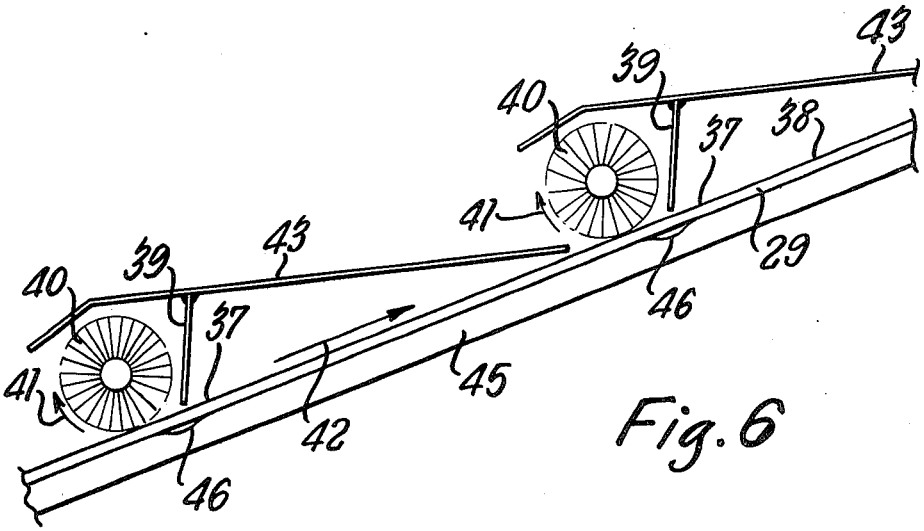
FIG. 6 is a diagrammatic side elevation of part of the apparatus of FIG. 5.

A second embodiment of apparatus according to the invention will now be described with reference to FIGS. 5 and 6 which illustrate a piece of apparatus which is designed for a greater throughput of seeds than the embodiment of FIGS. 1 to 3. In the embodiment of FIGS. 5 and 6 an endless belt 29 is used, of the same material as that of the previous embodiment as described in relation to FIG. 4. This endless belt 29 passes over a lower roller 30 and an upper driven roller 31 in much the same way as in the previous embodiment.

Positioned down one longitudinal edge of the upper run of belt 29 is an inlet duct 32 having an inlet opening 33 for the mixture to be fed from a hopper (not shown) and on the other longitudinal edge of the belt 29 is an outlet duct 34 leading to a discharge opening 35.

Within the inlet duct 32 are mixture separators 36 which divide the mass of the mixture falling down inlet duct 32 into separate and substantially equal portions and feed the portions to deposit areas 37 on the upper surface 38 of the belt 29. These deposit areas 37 are immediately above and at one end of a series of parallel fences 39 which are similar to the fences of the previous embodiment although they do not have any opening which permits the mixture to drop from one fence to a next lowermost fence. In this particular embodiment each fence acts independently to separate the selected seeds from the unwanted seeds or bodies.

Each fence 39 has an associated brush 40 above the fence and these brushes 40 are driven in any suitable manner (not shown) in the direction of arrows 41 and since the belt 29 is moving in the direction of arrow 42, it will be noted that the brushes 40 and the surface 38 at the line of contact are moving in opposite directions.

Immediately below each brush 40 is a plate 43 which overlies the next lowermost fence 39 and brush 40, and successive plates 43 are in overlapping relation so as to form a continuous surface over which unwanted seeds or bodies separated from the mixture may fall to be deposited through an outlet 44.

The upper run of belt 29 is supported by a base 45 which immediately beneath each fence 39 is provided with a depression 46 so as to permit the belt 29 to move temporarily downwardly underneath the fence 39 if necessary.

The apparatus of FIGS. 5 and 6 operates in the following manner. A mixture of selected seeds and unwanted seeds or bodies is fed from a hopper into inlet 33 and in passing down inlet duct 32 is separated into approximately equal portions by separating means 36. Each said portion is deposited on to a deposit area 37 associated with a fence 39. The belt 29 is moving upwardly in the direction of arrow 42 and the brushes 40 are all being driven. The mixture rolls down the fences 39 with a rolling and tumbling action repeatedly presenting individual seeds and bodies to the surface, during which the unwanted seeds or bodies because of their hairy nature and/or peculiar shape are caught up by the tufts 27 on the surface 38 of the belt 29 and are carried upwardly. Any unwanted seeds or bodies so carried upwardly then meet a rotating brush 40 whereupon they are separated from the belt and hurled into an exit path. This exit path consists of the various overlapping plates 43 down which the unwanted seeds or bodies fall into the outlet 44. Any unwanted seeds or bodies which find their way beneath the brush 40 can pass under the next fence 39 by the depression 46 permitting the belt a temporary downward movement and any of the unwanted seeds or bodies which find their way to the vicinity of the driving upper roller 31 are removed by a brush (not shown) in a similar manner to that of the FIGS. 1 to 3 embodiment.

Selected seeds roll down each fence 39 and into the discharge duct 34 and hence to the discharge outlet 35.

It is to be noted that each of the fences 39 is either in contact with or very closely spaced from the upper surface 38 of belt 29 and therefore none of the mixture in being deposited on to the deposit area 37 finds its way underneath the fence 39 to which it has been fed.

The apparatus of the present invention is applicable to the separation of various types of seeds but is particularly useful for separating wild oats from wheat and the like. The unwanted wild oats by virtue of their hairyness and rough surface texture and because they are elongate in shape and therefore do not roll or tumble easily, tend to be separated from the seed mixture and are caught up on the tufts 27 of the belt. The remaining selected seed which is of rounder and a smoother nature and therefore rolls and tumbles more easily, moves down the surface to be discharged at the lower end of the apparatus.

Particularly with regard to the embodiment of FIGS. 5 and 6, it will be appreciated that more than one piece of apparatus as illustrated may be associated together to form a larger piece of apparatus handling a greater throughput. A common inlet may feed more than one separation apparatus. Also, other types of surface may be used for the endless belt, for example, mohair.

We claim:

1. Apparatus for separating selected seeds (as herein defined) from unwanted seeds or bodies (as herein defined) which includes a hopper for holding a mixture of selected seeds and unwanted seeds or bodies to be separated, an endless belt positioned so that its upper surface lies at an angle to the horizontal, means for driving said belt so that said upper surface thereof moves upwardly from its lower end toward its upper end, means for adjusting the speed of movement of said belt, means for adjusting the angle of inclination of said surface, at least one fence disposed immediately above said surface at an angle to the direction of movement of said belt so as to also be inclined to the horizontal, and means for feeding said mixture from said hopper on to a deposit area of said surface located above said fence so that said mixture tends to fall by gravity down the incline of said surface toward said fence opposite to the direction of movement of said belt whereby said mixture contacts said fence and is deflected laterally across said surface with individual seeds or bodies thereby being repeatedly presented to said surface thus effecting separation, said belt being provided with a pile included in the direction of movement of said surface and composed of bunches of plastic bristles disposed as tufts over the surface of said belt.

2. Apparatus for separating selected seeds (as herein defined) from unwanted seeds or bodies (as herein defined) which includes a hopper for holding a mixture of selected seeds and unwanted seeds or bodies to be separated, an endless belt positioned so that its upper surface lies at an angle to the horizontal, means for driving said belt so that said upper surface thereof moves upwardly from its lower end toward its upper end, means for adjusting the speed of movement of said belt, means for adjusting the angle of inclination of said surface, a plurality of fences disposed immediately above said surface at an angle to the direction of movement of said belt so as to also be inclined to the horizontal, each of said fences being inclined at an opposite angle to its neighbor to the direction of movement of said surface so as to provide a tortuous path for the downward movement of said mixture during separation, and means for feeding said mixture from said hopper on to a deposit area of said surface located above the uppermost one of said fences so that said mixture tends to fall by gravity down the incline of said surface toward said fences opposite to the direction of movement of said belt whereby said mixture successively contacts said fences and is deflected laterally across said surface by each of said fences with individual seeds or bodies thereby being repeatedly presented to said surface thus effecting separation.

3. Apparatus as claimed in claim 2, in which each said fence has an opening at its lower end through which said mixture may pass to the next lowermost fence.

4. Apparatus for separating selected seeds (as herein defined) from unwanted seeds or bodies (as herein defined) which includes a hopper for holding a mixture of selected seeds and unwanted seeds or bodies to be separated, an endless belt positioned so that its upper surface lies at an angle to the horizontal, means for driving said belt so that said upper surface thereof moves upwardly from its lower end toward its upper end, means for adjusting the speed of movement of said belt, means for adjusting the angle of inclination of said surface, a plurality of parallel fences disposed immediately above said surface at an angle to the direction of movement of said belt so as to also be inclined to the horizontal, each of said fences having a rotatable brush disposed upwardly thereof cooperating with said belt and rotatable in a sense so that at the line of contact the brush and belt are moving in opposite directions to effect removal of unwanted seeds or bodies separated at the respective fence and hurl the unwanted seeds or bodies into an exit path, and means for feeding said mixture from said hopper on to deposit areas of said surface located above said fences so that said mixture tends to fall by gravity down the incline of said surface toward said fences opposite to the direction of movement of said belt whereby said mixture contacts said fences and is deflected laterally across said surface with individual seeds or bodies thereby being repeatedly presented to said surface thus effecting separation.

5. Apparatus as claimed in claim 4, in which an inlet duct is provided which supplies a portion of said mixture to a position immediately upwards of each of said fences at a longitudinal marginal portion of said surface, and an outlet duct which receives separated selected seeds from the other longitudinal marginal portion of said surface.

6. Apparatus as claimed in claim 4, in which said exit path comprises a series of plates overlying said fences and brushes, said plates overlapping each other to present a continuous surface for the passage of separated unwanted seeds or bodies to a discharge outlet at the lower end of said belt.

7. Apparatus for separating selected seeds (as herein defined) from unwanted seeds or bodies (as herein defined) which includes a hopper for holding a mixture of selected seeds and unwanted seeds or bodies to be separated, an endless belt positioned so that its upper surface lies at an angle to the horizontal, means for driving said belt so that said upper surface thereof moves upwardly from its lower end toward its upper end, means for adjusting the speed of movement of said belt, means for adjusting the angle of inclination of said surface, at least one fence disposed immediately above said surface at an angle to the direction of movement of said belt so as to also be inclined to the horizontal, means for feeding said mixture from said hopper on to a deposit area of said surface located above said fence so that said mixture tends to fall by gravity down the incline of said surface toward said fence opposite to the direction of movement of said belt whereby said mixture contacts said fences and is deflected laterally across said surface with individual seeds or bodies thereby being repeatedly presented to said surface thus effecting separation, and a rotatable brush positioned at the top of said belt and in contact therewith for the removal of unwanted seeds or bodies from said belt, the brush and belt at the line of contact moving in the same direction and the brush with greater angular speed.

8. Apparatus for separating selected seeds (as herein defined) from unwanted seeds or bodies (as herein defined) which includes a hopper for holding a mixture of selected seeds and unwanted seeds or bodies to be separated, an endless belt positioned so that its upper surface lies at an angle to the horizontal, means for driving said belt so that said upper surface thereof moves upwardly from its lower end toward its upper end, means for adjusting the speed of movement of said belt, means for adjusting the angle of inclination of said surface, at least one fence disposed immediately above said surface at an angle to the direction of movement of said belt so as to also be inclined to the horizontal, means for feeding said mixture from said hopper on to a deposit area of said surface located above said fence so that said mixture tends to fall by gravity down the incline of said surface toward said fence opposite to the direction of movement of said belt whereby said mixture contacts said fence and is deflected laterally across said surface with individual seeds or bodies thereby being repeatedly presented to said surface thus effecting separation, and a bed plate supporting said surface of said belt, said bed plate beneath said fence being provided with a depression to permit said belt temporarily move away from the lower edge of said fence if said belt is carrying an unwanted seed or body.

9. A method of separating selected seeds (as herein defined) from unwanted seeds or bodies (as herein defined) which includes the steps of providing an endless movable belt having an upper surface movable along a path inclined to the horizontal, providing a plurality of fences spaced from one another along said path of movement of said upper belt surface and located immediately above said upper belt surface and disposed at an angle to the direction of movement of said upper belt surface so as to be inclined to the horizontal, arranging said fences alternately in oppositely inclined angles to the direction of movement of said upper belt surface to cause said mixture to contact said fences in succession and therefore to follow a tortuous path down said upper belt surface, feeding a mixture of selected seeds and unwanted seeds or bodies onto a deposit area of said upper surface of said belt located upwardly along the length of said surface from said fences, and driving said belt so that said upper surface moves upwardly along said inclined path and at such a speed that said mixture falls by gravity down the incline of said upper belt surface toward said lower end of said upper belt surface and toward said fences in the direction of movement of said belt to cause said mixture to contact said fences and be deflected laterally across said belt surface by said fences and thereby further causing individual seeds or bodies to be repeatedly presented to said belt surface and thus effecting separation with selected seeds rolling and tumbling down said fences against the direction of movement of said upper belt surface and being discharged at the lower end of said fences and unwanted seeds or bodies being conveyed up said inclined path in the direction of movement of said upper belt surface.

10. The method as defined in claim 9 further characterized by sizing said fences so that each one thereof extends substantially from one marginal edge portion to the other marginal edge portion of said upper belt surface, and by said step of feeding said mixture onto a deposit area being carried out by depositing it onto said upper belt surface adjacent a longitudinal edge thereof so as to be diverted by said fences successively from one to the other of said marginal edge portions of said upper belt surface.

11. A method of separating selected seeds (as herein defined) from unwanted seeds or bodies (as herein defined) which includes the steps of providing an endless movable belt having an upper surface movable along a path inclined to the horizontal, providing a plurality of fences spaced from one another along said path of movement of said upper belt surface and located immediately above said upper belt surface and disposed at an angle to the direction of movement of said upper belt surface so as also to be inclined to the horizontal, separating a mixture of selected seeds and unwanted seeds or bodies into a plurality of portions and feeding each such portion onto said upper belt surface immediately above a respectively associated one of said fences, driving said belt so that said upper surface moves upwardly along said inclined path and at such a speed that each portion of said mixture falls by gravity down the incline of said upper belt surface toward said lower end of said upper belt surface and toward its associated one of said fences in the direction opposite to the direction of movement of said belt to cause each portion of said mixture to contact its fence and to be deflected laterally across said belt surface by said fence and thereby further causing individual seeds or bodies to be repeatedly presented to said belt surface and thus effecting separation with selected seeds rolling and tumbling down each fence against the direction of movement of said upper belt surface and being discharged at the lower end of each fence and unwanted seeds or bodies being conveyed up said inclined path in the direction of movement of said upper belt surface, and brushing said upper surface of said belt upwardly of each of said fences and in advance of the next adjacent one of said fences to remove upwardly conveyed unwanted seeds or bodies from said upper belt surface before said upper belt surface passes under said next adjacent fence.

* * * * *